US005926146A

United States Patent [19]

Seck

[11] Patent Number: 5,926,146

[45] Date of Patent: Jul. 20, 1999

[54] DUAL-BAND FEED FOR MICROWAVE REFLECTOR ANTENNA

[76] Inventor: Gerry A. Seck, 342 Flittner Cir., Thousand Oaks, Calif. 91360

[21] Appl. No.: 08/841,763

[22] Filed: May 5, 1997

Related U.S. Application Data

[60] Provisional application No. 60/019,863, Jun. 17, 1996.

[51] Int. Cl.[6] ..... H01Q 21/28

[52] U.S. Cl. ..... 343/725; 343/772; 343/786; 343/895

[58] Field of Search ..... 343/725, 729, 343/781 R, 781 P, 776, 786, 895, 772; H01Q 1/36, 13/00, 21/28

[56] References Cited

U.S. PATENT DOCUMENTS

| | | | |
|---|---|---|---|
| 4,041,499 | 8/1889 | Liu et al. | 343/786 |
| 5,274,388 | 12/1993 | Ishizaki | 343/725 |
| 5,594,461 | 1/1997 | O'Neill | 343/895 |
| 5,835,057 | 11/1998 | Van Heyningen | 343/757 |

*Primary Examiner*—Michael C. Wimer

[57] ABSTRACT

A dual-band feed for use in a microwave reflector antenna. The feed for one band is a an open-ended waveguide or a horn-type feed and the feed for the second band is a helix antenna. The wave-guide or horn-type antenna is located inside of the helix antenna and concentric with the helix antenna so as to cause the beams from the two feeds that are reflected by the reflector to be directed in the same direction.

4 Claims, 2 Drawing Sheets

DUAL-BAND FEED FOR MICROWAVE REFLECTOR ANTENNA

0. CROSS-REFERENCES TO RELATED APPLICATIONS

This application claims the benefit of U.S. Provisional Application No. 60/019,863 filed Jun. 17, 1996.

1. BACKGROUND OF THE INVENTION a. Field of the Invention

This invention pertains to feed systems for microwave reflector antennas. More particularly this invention pertains to feeds for microwave reflector antennas used for communicating with commercial earth satellites.

b. Description of the Prior Art

Commercial earth satellites, such as the DBS and Echostar satellites, are being used to broadcast television signals direct to consumers. One type of antenna system used by the consumer for receiving the television signals includes a reflecting dish in the form of an offset parabolic reflector that is fed by a waveguide horn or open-ended waveguide with associated chokes. These systems operate at Ku band, i.e. in a frequency band centered at approximately 12.5 ghz.

Commercial earth satellites now also provide a means for telephonic communications direct to consumers using circularly polarized radio waves in the L band frequency range, i.e. in a frequency band centered at approximately 1.5 ghz. Certain of the earth satellites that are used for the broadcasting of television signals direct to the consumer and certain of the earth satellites that provide the telephonic communications are located very close to each other as viewed by the consumer from the surface of the earth. In the prior art, completely separate antenna systems were used to provide reception of such direct broadcast television signals and to provide telephonic communications.

2. SUMMARY OF THE INVENTION

The present invention uses a combination of two separate microwave feeds to illuminate a single offset parabolic reflector so as to provide in a single antenna system both for the reception of direct broadcast television signals at 12.5 ghz. and for telephonic communications at 1.5 ghz. This invention uses a open-ended waveguide feed or horn and an offset parabolic reflector to receive the direct broadcast television signals and a feed consisting of a helix antenna that illuminates the same offset parabolibic reflector to provide telephonic communications. The waveguide feed is located within the center of the helix such that the beams from both the waveguide feed and the helical feed that are reflected from the offset reflector are pointed in substantially the same direction in space thus allowing simultaneously reception of direct broadcast television signals and telephonic communications with the satellites that are located in approximately the same angular position in space.

3. BRIEF DESCRIPTION OF THE DRAWINGS

4. DETAILED DESCRIPTION

Figure 1:
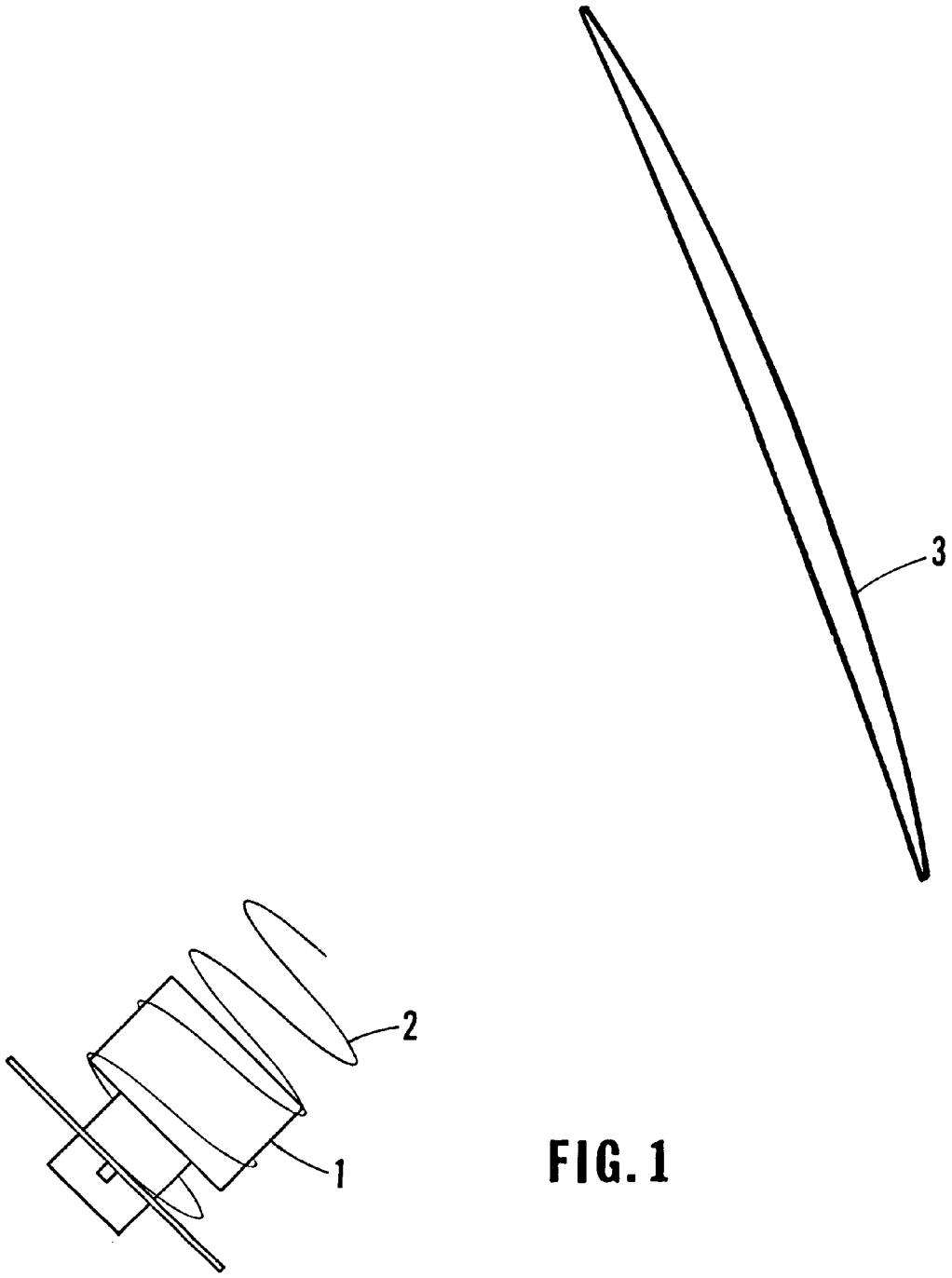
FIG. 1 is a pictorial depiction of the invention as used with an offset parabolic reflector.

Referring to FIG. 1, the combination of an open-ended waveguide or horn-type feed 1 together with a helical feed

2 are used to illuminate an offset parabolic reflector 3. Although the feeds 1 and 2 could instead be used to illuminate a reflector that is not offset, the preferred embodiment uses an offset reflector.

Figure 2:
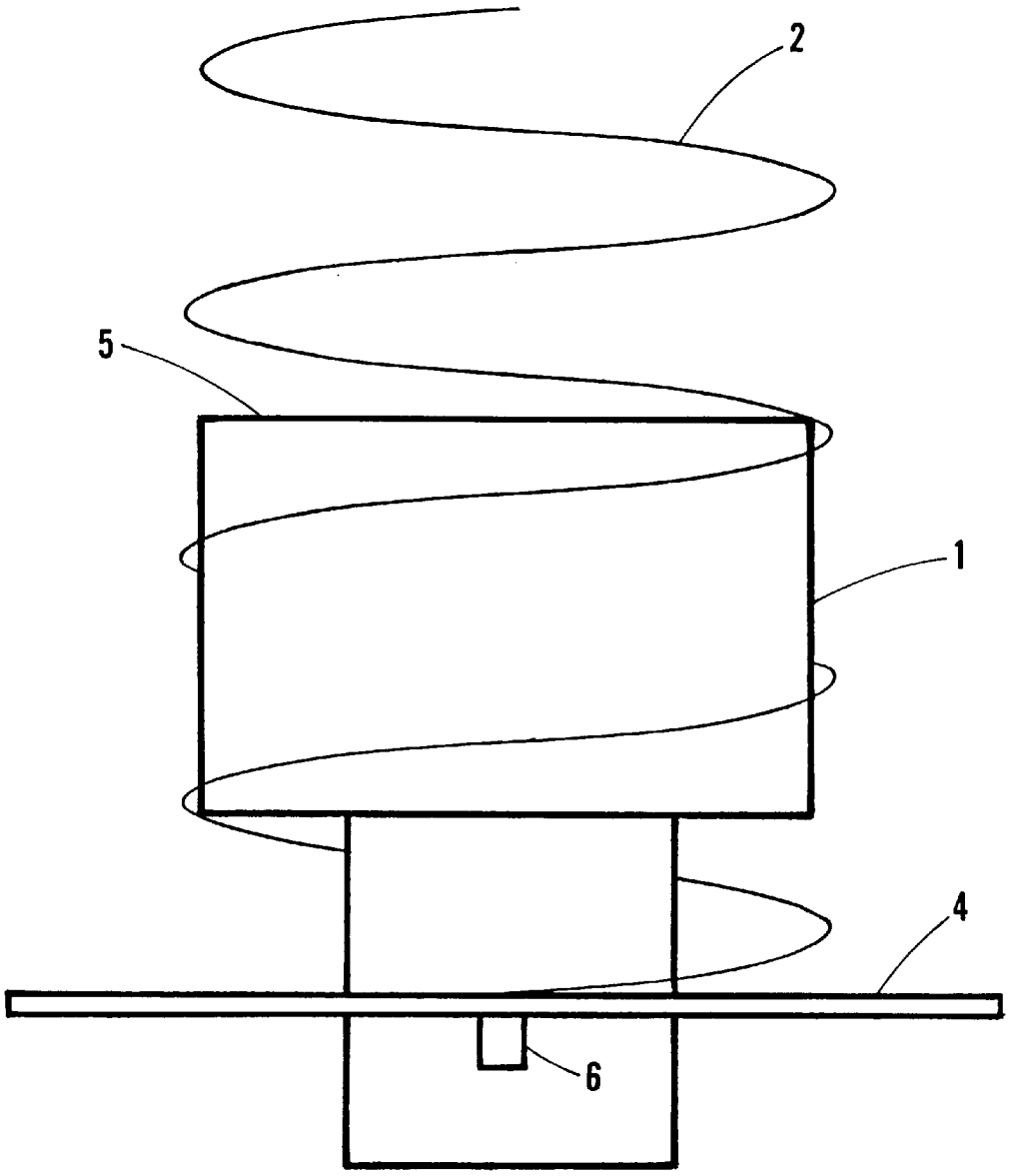
FIG. 2 depicts the feed consisting of the combination of a waveguide or horn feed and a helical feed.

An existing waveguide feed such as the Model ACR1S low noise feed/block downconverter marketed by Grundig or the model SAC-DA101 low noise feed/block downconverter marketed by Sony can be used as feed 1 to receive direct broadcast television signals at Ku band frequencies. Helix feed 2 consists of a conductor in the form of a helix of the general type such as that described in chapter 6 of "Antenna Therory and Design" by Warren L. Stutzman and Gary A. Thiele, published by John Wiley & Sons, Inc. 1981. In the preferred embodiment, for use at L band, the helix consists of between 3 and 4 turns having a pitch of approximately one turn per inch and having an inside diameter of approximately 2.5 inches. As depicted in FIG. 2, helix feed 2 surrounds the waveguide feed 1 and extends from a conducting baseplate 4 to somewhat beyond face 5 of waveguide feed 1. The helix is fed at baseplate 4 and approximately one turn of the helix extends beyond face 5 of waveguide feed 1. Helix 2 is fed by attachment of one end of the helix to to the central conductor of coaxial connector 6. As indicated in FIG. 2, for simultaneous operation at Ku band and L band, the inside diameter of helix feed 2 is only slightly larger than the outside diameter of waveguide feed 1.

In the preferred embodiment, it has been found that the impedance match the helix feed 2 is improved if the pitch of a portion of the first turn of the helix is reduced so as to place that portion somewhat closer to the surface of baseplate 4.

I claim:

1. A feed for a microwave antenna comprising:

a first feed, said first feed being an open-ended wave guide, and a second feed comprising a helix, the first feed being located within and approximately concentric with the second feed.

2. A feed for a microwave reflector antenna comprising:

a first feed, said first feed being a horn feed, and a second feed comprising a helix, the first feed being located within and approximately concentric with the second feed.

3. A feed for a microwave reflector antenna comprising:

a first feed, said first feed being an open-ended wave guide, and a second feed comprising a helix and a conducting baseplate, the helix being mounted on the conducting baseplate, the first feed being located within and approximately concentric with said second feed.

4. A feed for a microwave antenna comprising:

a first feed, said first feed being a horn feed, and a second feed comprising a helix and a conducting baseplate, the helix being mounted on the baseplate, the first feed being located within and approximately concentric with the second feed.

* * * * *

UNITED STATES PATENT AND TRADEMARK OFFICE

CERTIFICATE OF CORRECTION

PATENT NO. : 5,926146
DATED : July 20, 1999
INVENTOR(S) : Gerry A. Seck

It is certified that error appears in the above-identified patent and that said Letters Patent is hereby corrected as shown below:

Title page, item [73], Assignee: insert –DATRON/TRANSCO INC, Torrance, Calif.

Signed and Sealed this

Nineteenth Day of October, 1999

*Attest:*

Q. TODD DICKINSON

*Attesting Officer*

*Acting Commissioner of Patents and Trademarks*